United States Patent [19]

Muscari

[11] Patent Number: 4,506,790

[45] Date of Patent: Mar. 26, 1985

[54] MERCHANDISE SUPPORT

[75] Inventor: Raymond F. Muscari, Lilburn, Ga.

[73] Assignee: International Beverage Supply, Inc., Atlanta, Ga.

[21] Appl. No.: 500,794

[22] Filed: Jun. 6, 1983

Related U.S. Application Data

[63] Continuation of Ser. No. 184,396, Sep. 5, 1980.

[51] Int. Cl.[3] ..... A47F 5/11

[52] U.S. Cl. ..... 211/59.4; 108/111; 248/174; 211/135

[58] Field of Search ..... 108/27, 107, 108, 109, 108/111; 211/126, 132, 186, 149, 49, 150, 499; 248/174

[56] References Cited

U.S. PATENT DOCUMENTS

| | | | |
|---|---|---|---|
| 814,706 | 3/1906 | Isacke | 248/174 X |
| 1,565,026 | 12/1925 | Moore | 248/174 |
| 1,947,195 | 2/1934 | Flynn | 248/174 X |
| 3,601,256 | 8/1971 | Bowers, Jr. et al. | 108/108 |
| 3,862,784 | 1/1975 | Heinrich | 108/108 X |
| 3,863,575 | 2/1975 | Kuns et al. | 108/111 |
| 3,987,737 | 10/1976 | Smith | 108/111 |
| 3,990,578 | 11/1976 | Roeser | 248/174 X |
| 4,151,803 | 5/1979 | Ferrera et al. | 211/135 X |
| 4,164,287 | 8/1979 | Muller et al. | 108/111 X |
| 4,186,666 | 2/1980 | Honickman | 108/107 |
| 4,311,100 | 1/1982 | Gardner | 108/111 |
| 4,322,005 | 3/1982 | Robertson | 211/495 |

FOREIGN PATENT DOCUMENTS

| | | | |
|---|---|---|---|
| 194348 | 3/1923 | United Kingdom | 248/174 |

*Primary Examiner*—William E. Lyddane
*Assistant Examiner*—Peter A. Aschenbrenner
*Attorney, Agent, or Firm*—Patrick F. Henry

[57] ABSTRACT

A merchandise support, of the sort often used in supermarkets for displaying and vending merchandise in supermarkets in vertical relationship, may be constructed entirely from cardboard, boxboard, or other sheet material which may be cut and fabricated similar to the procedure used in making a folding box. A base comprises a vertical back panel having opposed side panels folded forward therefrom to create a three-dimensional support. A shelf support, which is ultimately positioned to become part of the base, comprises a three-dimensional box-like vertical shelf support insert which comprises front and rear panels. The front panel is provided with a plurality of vertically spaced normally horizontal slots in which individual shelves are positioned. A bottom panel extends forwardly and is positioned inside the base. Each shelf comprises a flat panel which is cut to form a rear folding flap inserted in a respective slot, and small tabs which are bent out of place and extend downwardly whereby the shelf is held in place. Each shelf rests on the merchandise such as plastic bottles of soft drink, detergent, bleach or the like which is positioned on the shelf below.

29 Claims, 6 Drawing Figures

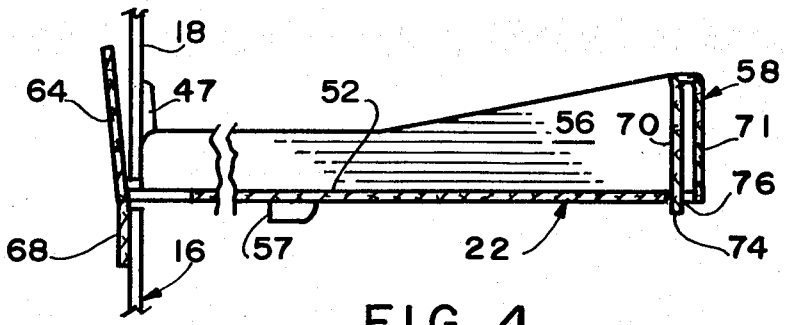
FIG. 4
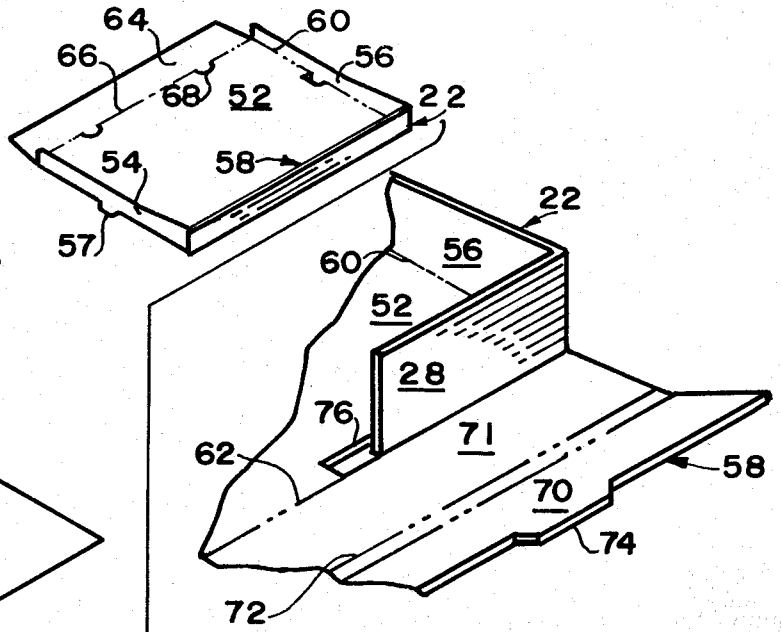
FIG. 5
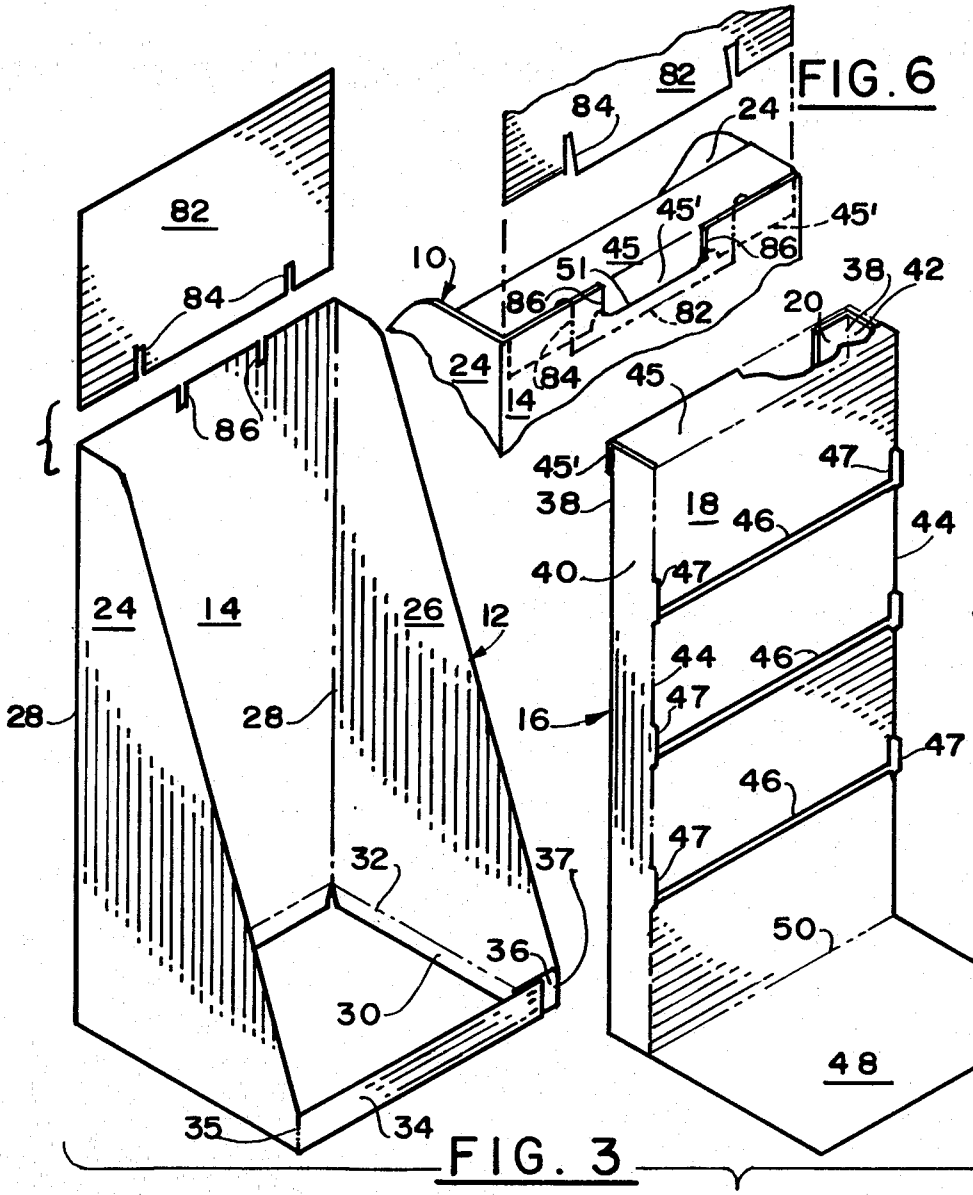
FIG. 6
FIG. 3

MERCHANDISE SUPPORT

This is a continuation of application Ser. No. 184,396, filed 9-5-80.

BACKGROUND OF THE INVENTION

1. Field of the Invention

The field of the invention is racks and supports and merchandise holders and particularly merchandise racks and supports having normally horizontal shelves which may be folded out of the way or removed to expose the merchandise below.

2. Description of the Prior Art

The prior art includes wire racks and supports which have been used in supermarkets and other places for years to support merchandise such as cartons of soft drinks in a stacked relationship on shelves which are spaced vertically from one another. Such arrangements conserve floor space and may be easily located in available places in a store. Wire racks are expensive, heavy and not well suited to holding individual plastic bottles of the sort which are commonplace in supermarkets these days. Such arrangements are disclosed in the following U.S. Pat. Nos.: 2,062,164; 3,139,192; 3,621,820; 3,677,203. None of the merchandise supports or racks disclosed in these patents are suitable for manufacture entirely from cardboard, boxboard or other relatively inexpensive materials of that type including laminated materials and lightweight metals. The present rack does not require any forming or bending of wire of other fabrication and assembly of wire members and the present merchandise support is so relatively inexpensive in comparison with such prior racks that one of the present racks may be destroyed after a short period of use.

SUMMARY OF THE INVENTION

The present invention comprises a vertical support constructed entirely from lightweight panel material and comprising a plurality of normally horizontal slots in which there are positioned individual, respective shelves constructed from lightweight inexpensive material and vertically spaced for holding merchandise.

An object of the present invention is to provide a merchandise support which may be constructed entirely from lightweight, relatively inexpensive panel material such as cardboard or boxboard which has been cut and folded into position.

Another object of the present invention resides in the construction of the individual shelves which are held in place through the use of a small folded strip or tab and smaller tab members inserted into a slot.

A further advantage of the present invention is found in the construction thereof whereby the entire merchandise support may be folded into a compact box which is easily unfolded and set up in place in a supermarket or the like.

Other and further objects and advantages of the present invention will become apparent upon reading the following description of a preferred embodiment taken in conjunction with the accompany drawings.

BRIEF DESCRIPTION OF THE DRAWINGS

FIG. 3 is a perspective view of the main components of the present invention which have been individually set-up for final assembly into the support shown in FIG. 1.

FIG. 4 is a cross-sectional view of a portion of the shelf and the back support taken along lines 4—4 in FIG. 1.

FIG. 5 is a partial perspective view of one corner of a shelf prior to final assembly and showing the way the front edge and a corner of the shelf is folded into place.

FIG. 6 is a partial perspective view of the top, rear of the assembled support in FIG. 1 showing an attachment between components.

DESCRIPTION OF A PREFERRED EMBODIMENT

Figure 2:
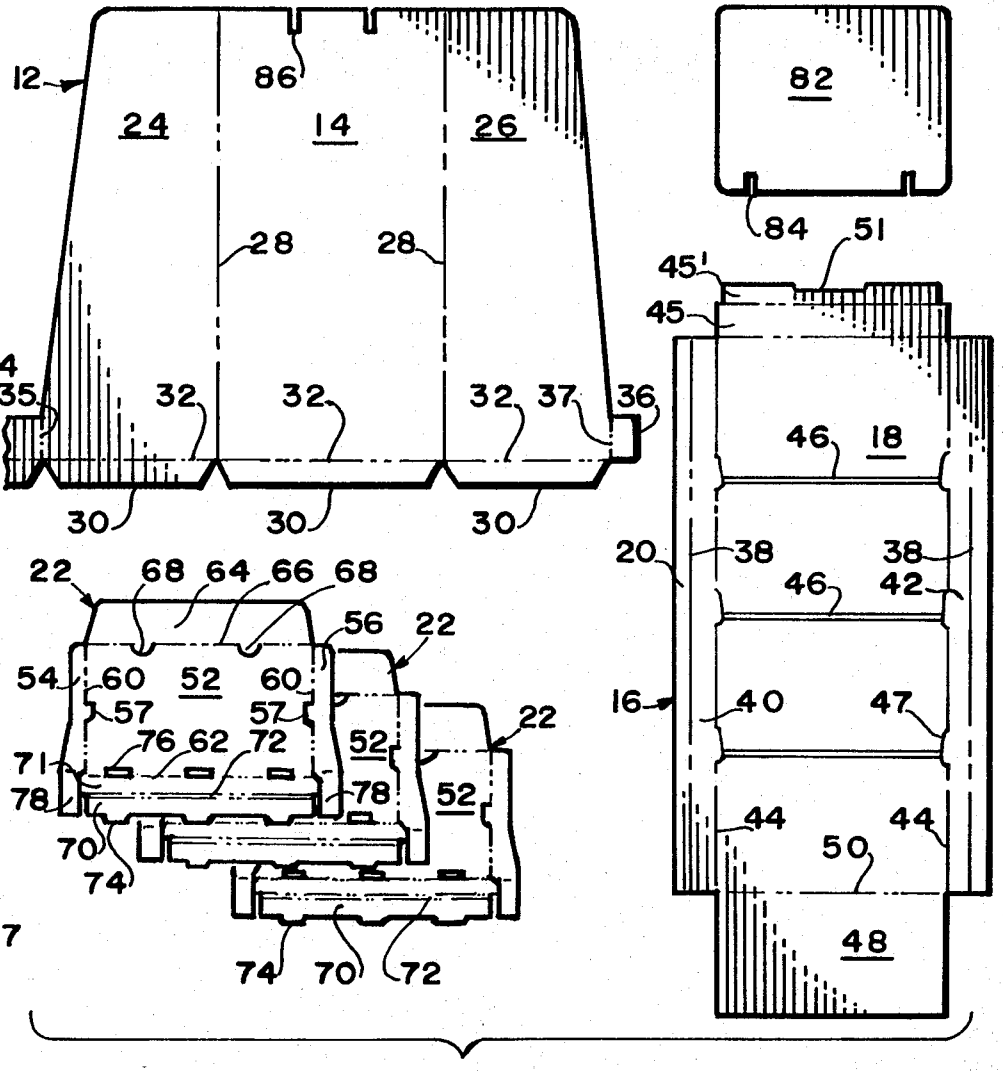
FIG. 2 is a disassembled assembly view of the individual components comprised in the assembly shown in FIG. 1.

The complete assembled merchandise unit is identified by reference numeral 10 and comprises basically three component parts: an open, three-dimensional housing 12 which functions as a cover and vertical back panel 14; a shelf support 16 which is a box-like structure comprising spaced panels: a front panel 18 and smaller back panels 20; and individual shelves 22 which are supported at the rear on the front panel 18.

Figure 1:
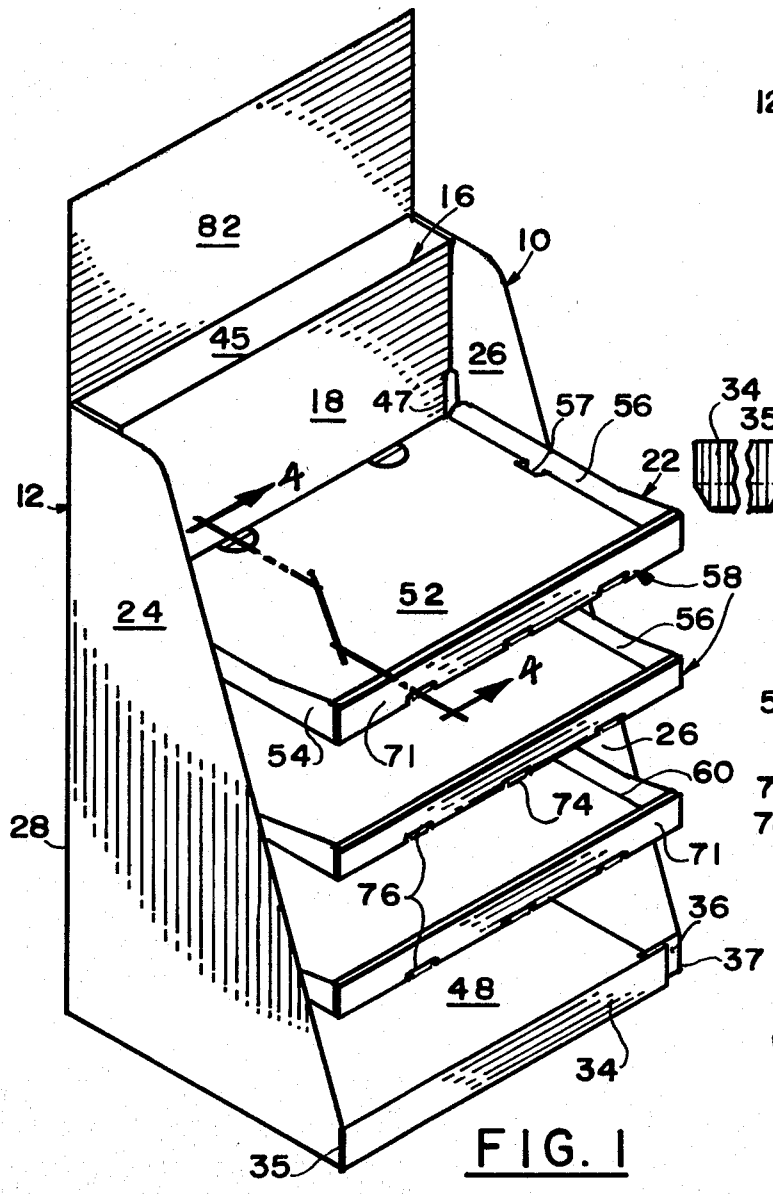
FIG. 1 a perspective view of an assembled merchandise support constructed in accordance with the present invention.

Referring to FIG. 2, the housing 12 is constructed to be folded from a two-dimensional panel (e.g. cardboard) that may be cut or formed in the general manner and method of making cardboard boxes and die cutting other panel material. In addition to the back panel 14, housing 12 comprises tapered side panels 24, 26 which are foldable along scored fold lines 28 to create a three-dimensional outside structure shown in FIGS. 1 and 3 and which includes inwardly turned bottom, marginal strips 30 which are folded along respective score lines 32 on the respective side panels 24, 26 and the back panel 14 to create the inwardly turned bottom margin (FIG. 3). There is a front strip member 34 which bends and extends from the bottom of side panel 24 about a line 35 and is attached to a short strip member 36 which extends and bends from the bottom of panel 26 about a line 37 to hold the side panels 24, 26 in proper spaced and assembled three-dimensional relationship.

The shelf support 16 comprises a front panel 18 and the two smaller back panels 20 which are folded along respective scored fold lines 38 into respective end panels 40, 42 which are folded along lines 44 spacing the back panels 20 from front panel 18. The panels 18, 20 and end panels 40, 42 are folded together in the manner shown in FIG. 3 to assemble the shelf support into a box-like construction that is hollow on the inside. A top panel 45 bending along a line on panel 18 has an end strip 45' that is folded inside of back panels 20. Front panel 18 is provided with a plurality of elongated, normally horizontal slots 46 each of which is cut from the panel 18 and in assembled condition the slots 46 lead to the hollow interior space between front panel 18 and in assembled condition the slots 46 lead to the hollow interior space between front panel 18 and back panels 20 of the composite shelf support 16 when it is in the assembled condition shown in FIG. 1 and FIG. 3. At the end of each slot 46 is a small vertical slot 47 for receiving and accommodating the shelf 22. The entire assembly includes a bottom panel 48 that is folded along a scored fold line 50 on the front panel 18 and inserted on top of the margin which is created by the strips 30. Strip 45' has a slot 51 therein. The assembled shelf support 16 is placed inside the housing 12 in the manner shown in FIG. 1 so that the housing 12 is a cover that provides extra structure, and the shelf support 16 may be attached to housing 12 as mentioned hereinafter.

An individual shelf 22 comprises a shelf bottom 52, opposed side edges 54, 56 and a front marginal edge 58 which are folded into position in the manner of the evolution apparent from the unfolded flat shelf of FIG. 2, which may be cut on conventional machinery, to the three-dimensional folded shelf which is shown in FIG. 3. Each side edge 54, 56 has a small tab 57. Side edges 54, 56 are foldable along respective fold lines 60 that have been scored on the material and a composite front edge 58 is foldable along a respective scored fold line 62. There is a back shelf strip 64 which is foldable along a respective fold line 66 on the bottom 52 and this functions as a shelf retainer together with a pair of small tabs 68 which are cut into the material and fold out of position in the manner shown in FIGS. 1 and 4.

The composite front edge 58 is folded from two strips 70, 71 folded along common respective score lines 72 and includes plurality of small tabs 74 (there being three such tabs in the present embodiment) which are inserted into respective slots 76 that have been cut into the bottom 52. Referring to FIG. 5 it is seen that the composite front edge is folded into place by bringing the strip 70 about the score line 72 and over a small tab 78 which is a continuation of and is folded on the end of each of the respective side members 54, 56. Tab 68 fits into slot 46 and tab 74 snaps into a respective slot 76 thereby holding the shelf 22 in the three-dimensional assembled position shown in FIG. 1 and FIG. 3.

Each shelf 22 is inserted into place in the assembled support 10 by inserting the strip 64 through the respective slot 46 so that the strip 64 will assume a normal position inclined upwardly in the manner shown in FIG. 4 and the small tabs 68 assume a downwardly inclined position in the manner shown in FIG. 4 whereby each shelf is retained and held in place on the front panel 18. Normally starting with the bottom 48 merchandise such as plastic containers of soft drink, bleach or other bottles are placed on each shelf 22 which rests on the top of the bottles therebelow and the weight of the merchandise on a particular shelf below and ultimately the floor upon which the bottom 48 rests. An entire shelf 22 can be pushed through a slot 46 and the small slots 47 accommodate the edges 54, 56 whenever the shelf 22 is raised slightly.

An advertising panel 82 has a pair of opposed slots 84 therein and is fitted onto top edge of the back panel 14 by bending a portion between slots 84, preferably after first assemblying the shelf support 16 top panel 45 and end strip 45' with the back panel 14 in the slots 86 in the manner shown in FIG. 6. End strip 45' is bent so that the portion of strip 45' between slots 86 lies outside panel 14 and the remainder of strip 45' lies inside panel 14 to attach back panel 14 to the shelf support 16 for structural stability although the system will work without this attachment.

While we have shown and described a particular embodiment of my invention together with a suggested mode of operation and construction thereof this is by way of illustration and does not comprise any sort of limitation on the scope of my invention because there are various alterations, changes, deviations, eliminations, substitutions, additions and departures which may be made in the preferred embodiment without avoiding the scope of the invention as defined only by a proper interpretation of the appended claims.

What is claimed is:

1. In a merchandise support which may be constructed from corrugated material:

a normally vertical shelf support for supporting a plurality of shelves and a plurality of normally horizontal vertically spaced shelf slots on said vertical support, said slots being of a length across the width of said support to accommodate at least part of one end of the shelf inserted therethrough, a plurality of movable merchandise support shelves for selective assembly on said support in a respective selected slot therein, each of said shelves being movable along a fold line at said slot from a substantially horizontal position upwardly to a raised position to expose merchandise and comprising a shelf bottom, front and rear ends and a movable shelf retaining member on the rear end of the said shelf inserted through said slot to extend behind said support, each shelf being supported by the merchandise, such as bottles, therebelow and the lowermost merchandise being supported on the floor whereby as the merchandise is removed completely from each shelf that shelf may be inclined upwardly and thereby moved to expose the merchandise on the shelf therebelow which merchandise is resting on the merchandise beneath it so that the support for the shelves is by means of the merchandise resting on the floor or ground surface.

2. The device in claim 1 wherein there is a respective stop means on said shelves resisting dislodgement of said shelf from said slot.

3. The device in claim 1 wherein there is a respective stop means resisting said shelf from being inserted too far in said slot.

4. The device in claim 1 wherein said shelf support includes a substantially flat front panel having said slots therein and side panels extending from said front panel.

5. The device in claim 4 wherein said shelf support is positioned within a housing having a back behind said shelf support and sides extending forwardly from said shelf support, said front panel on said shelf support being spaced from said back of said housing.

6. The device in claim 5 wherein: each of said support shelves comprises retaining members having portions extending downwardly behind said front panel and portions extending upwardly behind said front panel.

7. The device in claim 6 wherein said housing comprises a normally vertical back panel and spaced side panels having an opening therebetween.

8. The device claimed in claim 7 wherein said housing side panels each is tapered from bottom to top whereby the bottom of the housing extends outwardly more than the top of the housing to expose and vend the merchandise supported on said merchandise support shelves.

9. The device claimed in claim 8 wherein said housing is folded from a flat panel into the three-dimensional housing.

10. The device in claim 9 wherein there is a bottom margin inside the bottom of said housing comprising marginal edges folded inwardly therein, and a front strip on the bottom of said housing.

11. The device claimed in claim 1 wherein each of said shelves comprises three edges extending from said movable shelf retaining member on one edge and there is an upstanding margin on each edge.

12. The device claimed in claim 11 wherein the front margin on said shelf comprises a folded panel and the ends of the other adjacent respective margins includes a tab inserted between said folded panels.

13. The device claimed in claim 3, wherein: said normally vertical shelf support is a three-dimensional structure comprising a normally vertical front panel having the shelf slots therein, means supporting said three-dimensional support inside said housing, said shelves being installed in a respective slot and there being a plurality of said shelves vertically spaced one above the other on said support and at least partly within said housing.

14. The device claimed in claim 13, wherein: said shelf support is folded into the three-dimensional form from a blank constructed from material such as cardboard, fiberboard and the like, said housing being folded from a substantially flat blank made from a material such as cardboard, boxboard and fiber board and the like, and each of said shelves being folded from a flat blank.

15. In a merchandise support:

a three-dimensional housing comprising a back panel and spaced side panels having an opening therebetween, said housing evolving by folding said side panels from a flat panel, a shelf support means comprising a front panel and there being a means for supporting said shelf support means in a normally upright position inside said housing, a plurality of vertically spaced, normally horizontal, shelf slots extending substantially across the width of said front panel for a distance to accommodate the width of a respective shelf, and a plurality of shelves on said shelf support means, each of said shelves comprising a front edge, side edges and a back edge, each shelf being movable from a normally approximately horizontal load-bearing position resting on top of the merchandise below to an upwardly inclined position exposing the merchandise on the shelf therebelow, whereby the support for each shelf is from the merchandise beneath the shelf which merchandise in turn is supported by the merchandise below on the next successive shelf and so on to the merchandise which is supported on the floor or ground surface, whereby upon removal of the merchandise from the uppermost shelf said shelf may move upwardly to expose the merchandise therebelow and so on until the merchandise is successively removed from each shelf to the merchandise being supported on the floor or ground, and the rear of said shelf being movable along a fold line transversely of said shelf and corresponding to the direction of said slot.

16. The device in claim 15 including a movable retaining means on said back edge inserted through a respective slot in said front panel and said retaining means being out of the normal plane of the shelf thereby resisting dislodgement of said shelf from said slot.

17. The device claimed in claim 15 wherein said housing is three-dimensional and comprises a back panel and spaced side panels having an opening therebetween.

18. The device claimed in claim 17 wherein said spaced side panels are tapered from bottom to top whereby the bottom of said housing extends outwardly more than the top.

19. The device claimed in claim 18 wherein said housing is folded from a flat panel into the three-dimensional housing.

20. The device claimed in claim 19 including a bottom margin inside the bottom of said housing comprising marginal edges extending inwardly therein.

21. The device claimed in claim 20 wherein said bottom marginal edges are folded inwardly on the respective bottom edge of each of said back panel and side panels.

22. The device claimed in claim 21 wherein there is a front strip on the bottom of said housing which is folded across from one side member to the other.

23. The device claimed in claim 15 wherein said shelf support means is three-dimensional and comprises the front panel and side panels, and a means for supporting said shelf support means in a normally vertical position inside said housing.

24. The device claimed in claim 23 wherein said means for supporting comprising a flat panel on the bottom of said shelf support means normally extending outwardly inside said housing.

25. The device claimed in claim 24 wherein each of said shelves comprises small tabs which are attached to said retaining member.

26. The device claimed in claim 25 wherein said retaining means on said shelf comprises a back member extending from the back edge of said shelf bottom and folding along a fold line thereon.

27. The device claimed in claim 6 wherein said housing is attached to said shelf support.

28. The device in claim 27 wherein said housing is attached by means of interlocking portions on said housing and said shelf support.

29. The device in claim 28 wherein a portion of said housing has slots therein and said shelf support fits into said slots.

* * * * *